US008783177B2

(12) United States Patent
Giardino et al.

(10) Patent No.: US 8,783,177 B2
(45) Date of Patent: Jul. 22, 2014

(54) SYSTEM FOR OSCILLATING A ROLLER

(76) Inventors: Brian Giardino, Rochester, NY (US); Ronald Sweet, Conesus, NY (US); James Fischer, Rochester, NY (US); Gary Larsen, Webster, NY (US)

( * ) Notice: Subject to any disclaimer, the term of this patent is extended or adjusted under 35 U.S.C. 154(b) by 393 days.

(21) Appl. No.: 13/276,627

(22) Filed: Oct. 19, 2011

(65) Prior Publication Data

US 2013/0102444 A1 Apr. 25, 2013

(51) Int. Cl.
*B41F 31/06* (2006.01)
*B41F 31/14* (2006.01)

(52) U.S. Cl.
USPC ..... 101/352.06; 101/216; 101/423

(58) Field of Classification Search
USPC ..... 101/423, 348, 352.06, 350.03, 216, 101/217, 350.1
See application file for complete search history.

(56) References Cited

U.S. PATENT DOCUMENTS 3,110,253 A * 11/1963 Du Bois ..... 101/348
4,332,195 A * 6/1982 Mizumura ..... 101/350.3
4,753,167 A * 6/1988 Shriver ..... 101/485
5,060,568 A * 10/1991 Jentzsch et al. ..... 101/148
5,065,676 A * 11/1991 Hardin ..... 101/350.3
5,230,285 A * 7/1993 Cogswell et al. ..... 101/363
5,363,763 A * 11/1994 Fiore ..... 101/350.3
5,511,474 A * 4/1996 Junghans ..... 101/348
5,611,281 A 3/1997 Corrado et al.
5,771,805 A * 6/1998 Branas et al. ..... 101/248
5,855,172 A 1/1999 Corrado et al.
6,019,038 A * 2/2000 Kusunoki et al. ..... 101/216
7,077,061 B2 * 7/2006 Holm et al. ..... 101/212
7,086,330 B2 * 8/2006 Masuch ..... 101/217
7,096,782 B2 * 8/2006 Tobe et al. ..... 101/212
7,555,981 B2 * 7/2009 Saito ..... 101/352.01
8,322,281 B2 * 12/2012 Fischer ..... 101/349.1

* cited by examiner

*Primary Examiner* — David Bryant
*Assistant Examiner* — Jason L Vaughan
(74) *Attorney, Agent, or Firm* — Woods Oviatt Gilman LLP

(57) ABSTRACT

A system for oscillating a roller driven by rolling contact with a moving substrate. An oscillating assembly comprises first and second opposed gudgeons rotatably mounted on a shaft, the gudgeons being connected by either a plurality of rods or the roller. An oscillation mechanism comprises a reduction transmission assembly having differently toothed input and output pulleys. A cam groove in an oscillation cam is engaged by one or more oscillation pin(s) connected to the gudgeons. An input drive pulley turns with the gudgeons, and an output pulley turns with the oscillation cam. An intermediate double-pulley has second and third pulleys on a common hub. First and second timing belts connect, respectively, the input pulley to the second hub pulley, and the third hub pulley to the output pulley. A currently preferred step-down ratio between the input pulley and the output pulley is about 391:1.

18 Claims, 8 Drawing Sheets

SYSTEM FOR OSCILLATING A ROLLER

TECHNICAL FIELD

The present invention relates to apparatus for causing a rotating roller to oscillate axially, more particularly to such an apparatus wherein the roller is driven by rolling contact with a moving substrate, and most particularly to a system wherein the roller is a contact cleaning roller oscillated axially as it is rolled along a non-oscillating moving substrate surface to be cleaned by transfer of particles from the substrate to the contact cleaning roller.

BACKGROUND OF THE INVENTION

U.S. Pat. No. 5,611,281 issued Mar. 18, 1997 to Corrado et al., which is hereby incorporated by reference, discloses a system for axially reciprocating a tacky roller (also referred to herein as a contact cleaning roller, or "CCR") across a substrate being cleaned by the roller. Such reciprocation is useful for spreading particles which may be non-uniformly distributed on the substrate surface over a broader area of the CCR collecting surface, thereby decreasing the rate of decay of collecting efficiency, improving the average cleanliness of the treated substrate, and extending the operating lifetime of the CCR between renewals. In the prior art, the CCR is mounted in a movable frame which is journalled in linear bearings and is displaceable axially of the shaft by a controllable actuator.

To avoid scratching or scrubbing of the substrate surface by the CCR while the roller is simultaneously rolling along the surface in a first direction and axially sliding across the surface in a second and orthogonal direction, the rate of axial displacement is preferably very low; that is, the ratio of axial to rotational linear velocities is preferably between about 0.01 and about 0.0001. In practice, therefore, the reciprocating actuator may be required to operate at about 1 cycle per minute (cpm) or even less. It can be expensive and difficult to provide an actuating system having the capability for such smooth, slow motion. Such a system may require an actuator, air or hydraulic supply, and an electronic controller having this capability. In addition, such a system is subject to unwanted variation from misadjustment, wear, and drift in electronic and pneumatic components.

A mechanical system for smoothly oscillating a roller is disclosed in U.S. Pat. No. 5,855,172 issued Jan. 9, 1999 to Corrado et al., which is hereby incorporated by reference. The improved system comprises a shell having an electrostatically active outer surface, the shell being supported by a close-fitting rotatable shaft. The shaft within the shell is provided with a spiral cam groove extending from a first axial location to a second axial location disposed 180° from the first axial location, and then back to the first axial location. A cam follower attached to the inner surface of the shell rides in the cam groove, causing the shell to oscillate axially of the shaft at a frequency of oscillation which is the numerical difference between the rotational frequencies of the shell and shaft. Preferably, the shell is nipped against a backing roller, which may be an idle roller or a driven roller with a moving web substrate passing therebetween in contact with the working surfaces of both rollers. Outboard of the working surfaces, the shaft of the backing roller has a first drive roller having a first diameter, and the shaft of the barrel cam has a second drive roller nipped against the first drive roller and having a second roller diameter slightly different from the first roller diameter. Thus, the shell turns at a rotational frequency imposed by the linear velocity of the web substrate whereas the shaft turns at a different frequency as imposed by the relative diameters of the two speed-controlling drive surfaces, the frequency differential being equal to the oscillation frequency of the shell along the barrel cam.

A shortcoming of the prior art barrel cam system is that the mechanism that ratios the rotational rates of the shell and the barrel cam is rather cumbersome, requiring a roller pair that extends beyond the limits of the roller shell and includes a drive gear supported by the backing roller, and thus cannot be contained within the shell. Further, the mechanism cannot be contained largely within an axial envelope extension of the shell, making the apparatus unsuited to compact installations such as a "drawer slide" configuration.

What is needed in the art is a compact barrel cam arrangement that can be contained within a roller shell or largely within the axial envelope extension thereof.

It is a principal object of the present invention to provide a compact barrel cam system that can axially oscillate a roller rolling along a moving substrate surface.

SUMMARY OF THE INVENTION

Briefly described, a system for oscillating a roller driven by rolling contact with a moving substrate comprises an oscillating assembly and an oscillation mechanism. The oscillating assembly comprises first and second opposed gudgeons rotatably mounted on a shaft, the gudgeons being connected by either a plurality of rods or by the roller itself. The oscillation mechanism comprises a reduction transmission assembly having differently toothed input, intermediate, and output pulleys. A cam groove in an oscillation cam is engaged by one or more oscillation pin(s) operationally connected to the gudgeons.

The input drive pulley turns with the gudgeons, and the output pulley turns with the oscillation cam. An intermediate double-pulley has second and third pulleys on a common hub. First and second timing belts connect, respectively, the input pulley to the second hub pulley, and the third hub pulley to the output pulley. A currently preferred reduction ratio between the input pulley and the output pulley is about 391:1.

The pulleys may be toothed pulleys, in which case the reduction ratio is governed by the number of teeth on respective of the toothed pulleys. Alternatively, the pulleys may be non-toothed, in which case the reduction ratio is governed by the diameters of respective of the non-toothed pulleys.

In a first embodiment, the oscillation mechanism is disposed entirely within the oscillating assembly. In a second embodiment, the oscillation mechanism is contained principally within one of the gudgeons outboard of the oscillating assembly.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
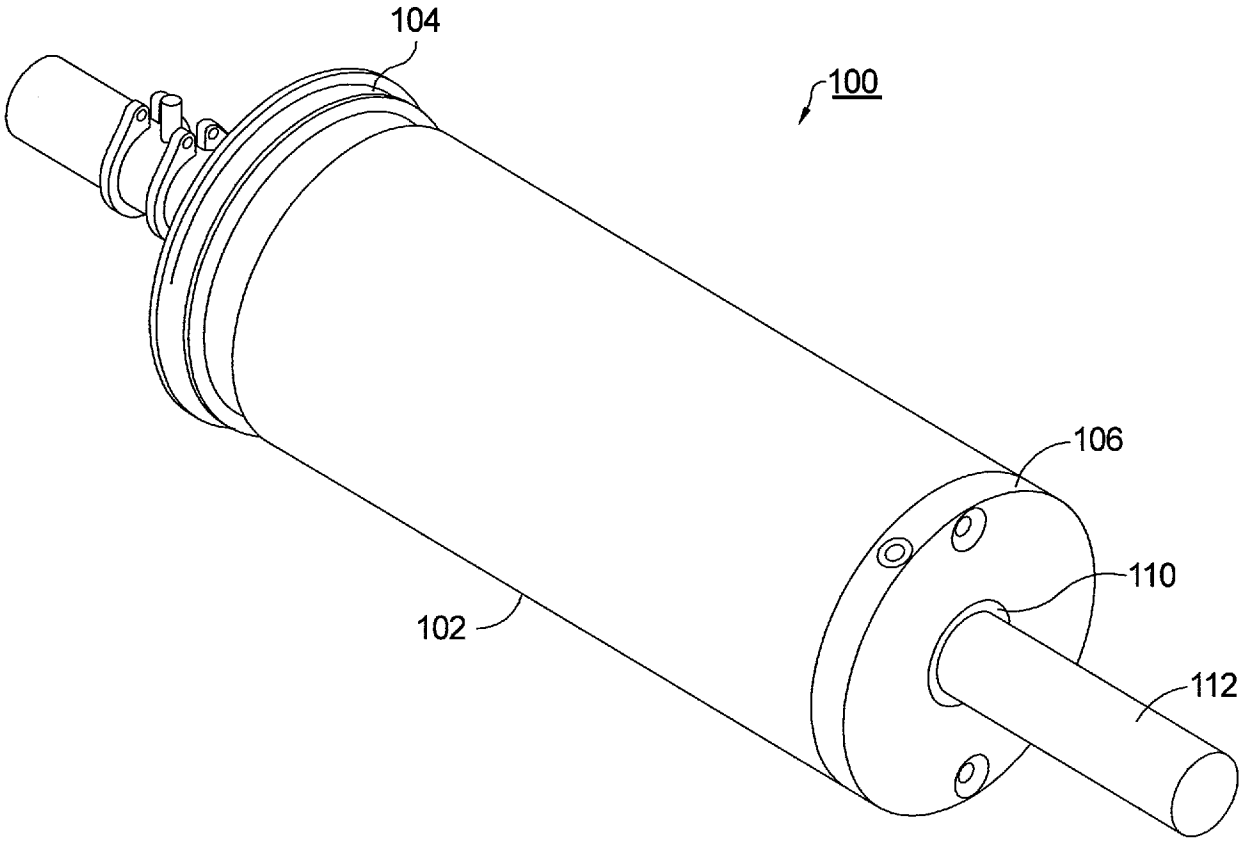
FIG. 1 is an isometric view of a first embodiment in accordance with the present invention.
Figure 2:
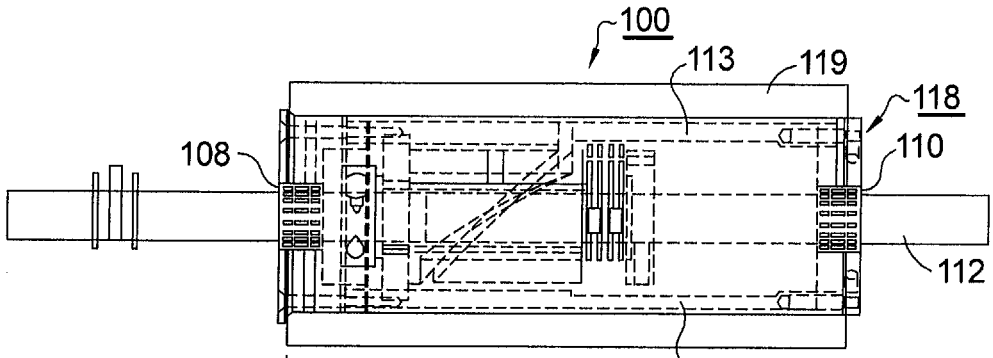
FIGS. 2 through 4 are sequential elevational cross-sectional views showing the embodiment shown in FIG. 1 in, respectively, oscillation right, oscillation center, and oscillation left positions.
Figure 3:
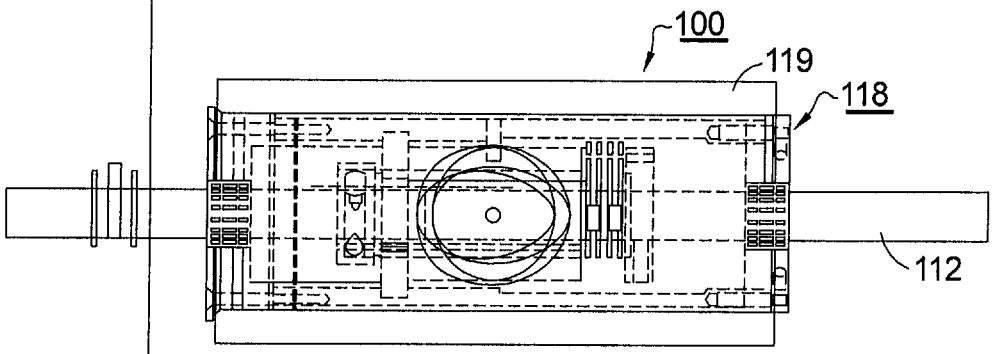
Figure 4:
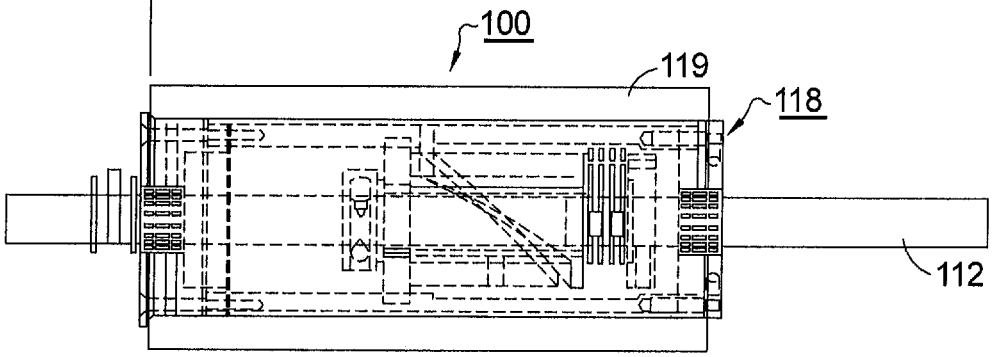
Figure 5:
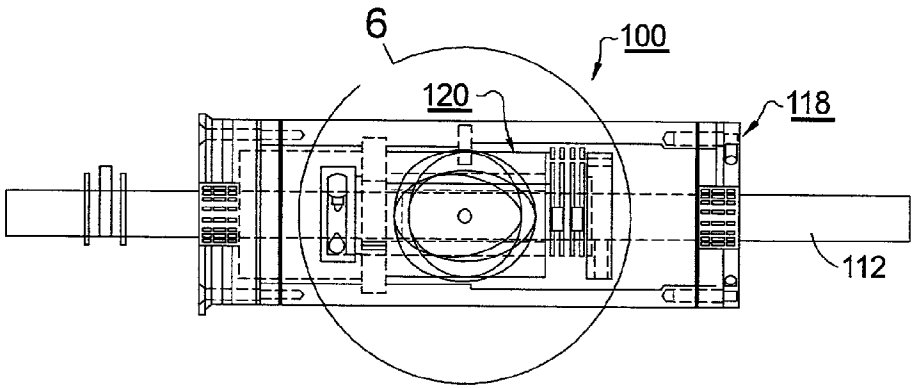
FIG. 5 is an elevational cross-sectional view similar to that shown in FIG. 3, showing an oscillation mechanism disposed within an oscillating assembly and gudgeons.
Figure 6:
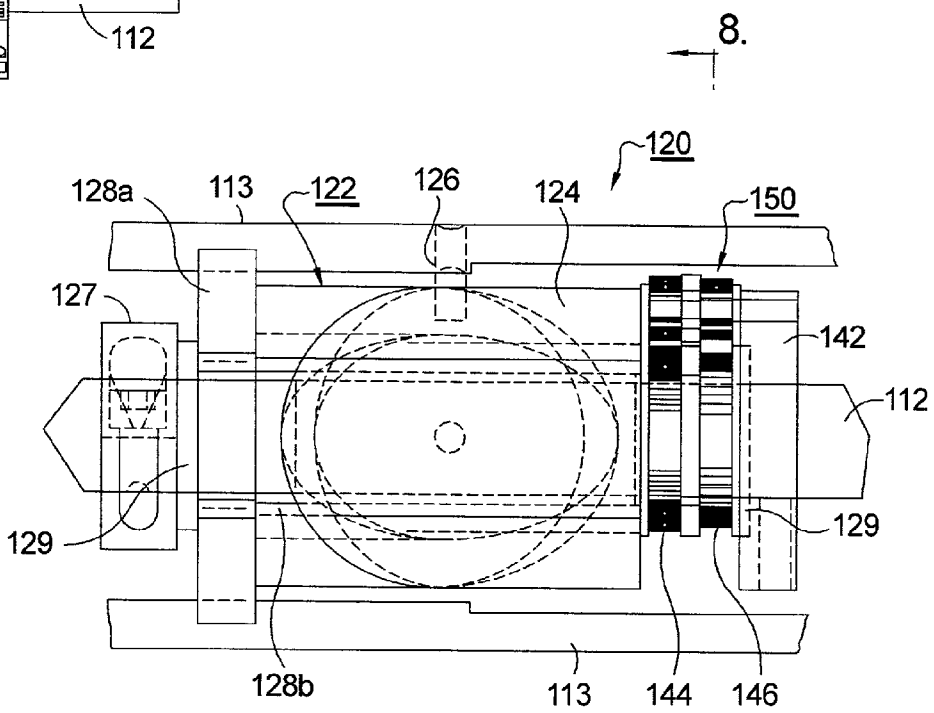
FIG. 6 is an enlarged view of the oscillation mechanism shown in circle 6 in FIG. 5.
Figure 7:
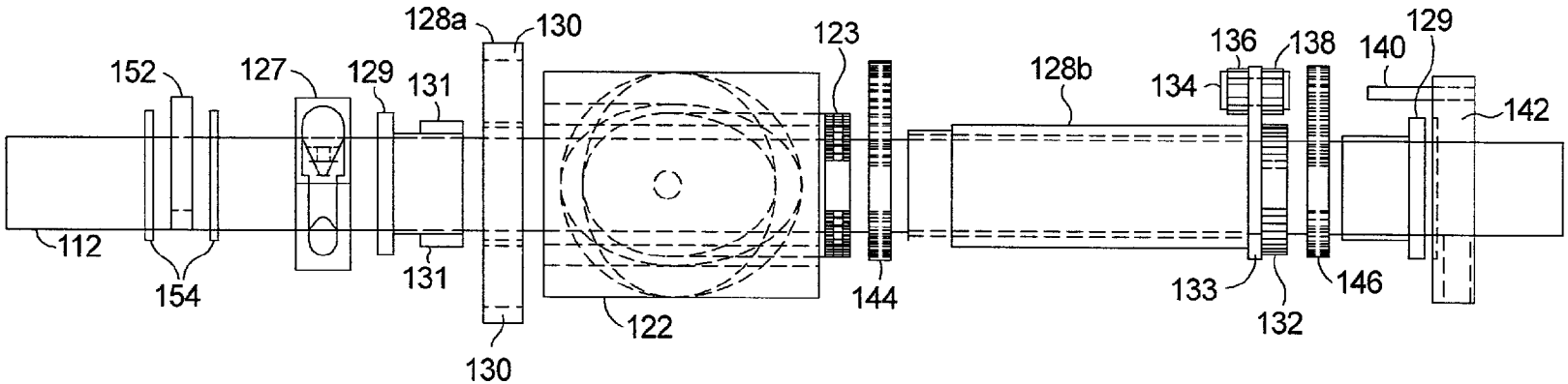
FIG. 7 is an exploded view of the embodiment shown in FIGS. 3 and 5.

Referring to FIGS. 1 through 5, a first embodiment 100 of an apparatus for axially oscillating a roller in accordance with the present invention comprises optionally an oscillation tubing sleeve 102 captured between first and second end gudgeons 104,106 slidably mounted via respective bearings 108, 110 on a non-rotatable shaft 112. The gudgeons are connected by a plurality of tie bars 113, preferably two, within sleeve 102. In operation, the oscillation tubing sleeve and gudgeons are caused to oscillate on the shaft between right and left extremes 114,116 of oscillation as shown in FIGS. 2 through 4 and described in detail below. This assembly, referred to herein as an oscillating assembly 118 of embodiment 100, is receptive of a removable/replaceable roll of a working material such as a tape roll or a contact cleaning roll 119 between gudgeons 104,106 and over sleeve 102 if optionally present, through which oscillating assembly 118 is rotatably driven by frictional contact with a moving substrate (not shown).

Referring now to FIGS. 5 through 8, wholly self-contained within oscillating assembly 118 is oscillation mechanism 120 that is fixed in axial position to shaft 112 but is freely rotatable thereupon as described below.

Figure 8:
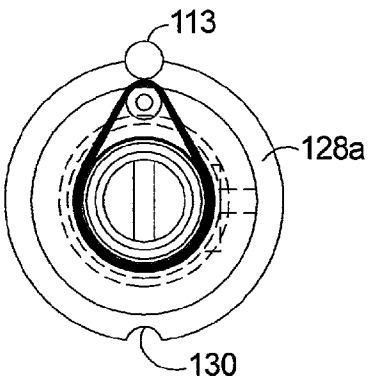
FIG. 8 is an elevational cross-sectional view taken along line 8-8 in FIG. 6.
Figure 9:
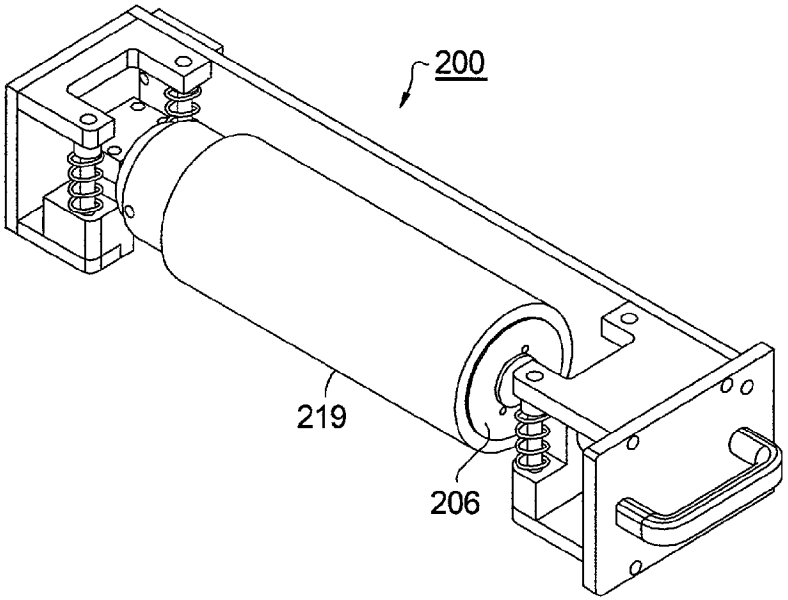
FIG. 9 is an isometric view of a second embodiment in accordance with the present invention disposed in a removable mount such as a "drawer slide" mount.
Figure 10:
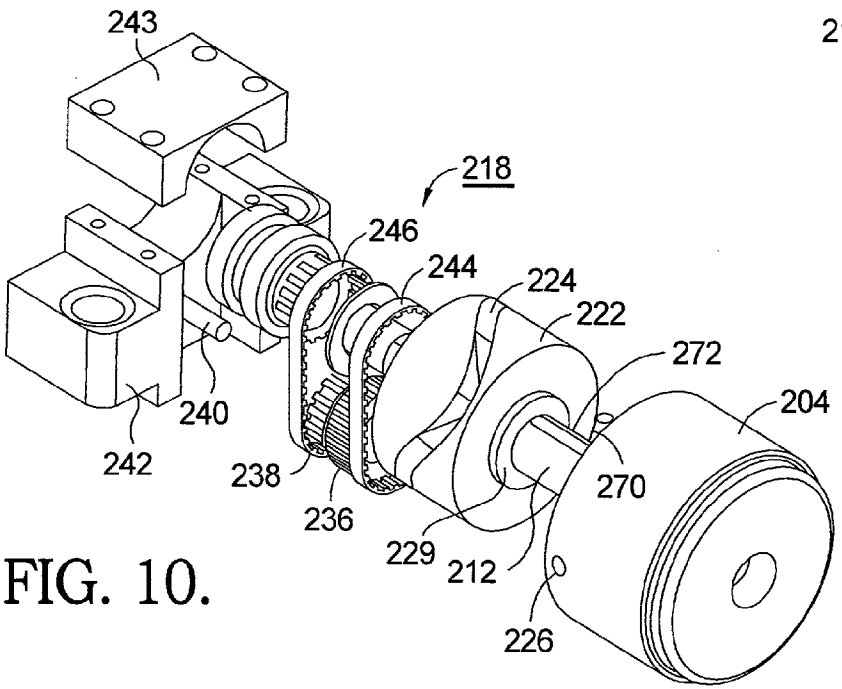
FIG. 10 is an exploded isometric view of the oscillation mechanism shown in FIG. 9.

Oscillation mechanism 120 comprises an oscillation cam 122 having at least one spiral groove 124 formed in the surface thereof for receiving at least one oscillation pin 126 fixed in at least one of tie bars 113 and extending radially inward therefrom. Oscillation cam 122 includes a first timing pulley 123. Oscillation cam 122 is supported by a two-part rotatable hub 128 comprising hub portion 128*a* and hub portion 128*b* extending through cam 122 and first timing pulley 123 and joined during assembly of mechanism 120. Assembled hub 128 is supported for rotation on shaft 112 by respective bronze shouldered bushings 129, at least one of which preferably is keyed via keys 131 to hub portion 128*a* and is retained in position by clamp collar 127. Hub portion 128*a* is provided with at least one notch 130, and preferably two, for engaging at least one of tie bars 113, as shown in FIG. 8, and also includes a second timing pulley 132. Hub portion 128*b* supports an arbor 133 for pulley hub 134 having integral third and fourth timing pulleys 136,138 disposed on opposite sides of arbor 133. Pulley hub 134 is rotatably supported on bronze shaft 140 extending from end plate 142. A first timing belt 144 is connected to first timing pulley 123 and third timing pulley 136. A second timing belt 146 is connected to second timing pulley 132 and fourth timing pulley 138.

Shaft 112 is prevented from rotation by pin 152 and from axial chucking by retaining rings 154.

The numbers of teeth in the four timing pulleys and in the two timing belts are carefully selected to provide for a desired ratio of rotation rate about shaft 112 between oscillating assembly 118 and oscillation mechanism 120. Thus the timing pulleys and timing belts define a reduction transmission 150 having a fixed reduction ratio.

Note that the embodiment just described comprises toothed pulleys and toothed belts, in which case the reduction ratio is governed by the number of teeth on respective of the toothed pulleys. Alternatively, the pulleys may be non-toothed, in which case the reduction ratio is governed by the diameters of respective of the non-toothed pulleys.

Note further that pinion gears may be substituted for toothed pulleys; in a special case, belts 144,146 may be omitted and the pinion gears meshed directly, wherein the reduction ratio is governed by the respective numbers of teeth on the pinion gears. In an additional special case, the teeth may be omitted from the pinion gears, resulting in the "pulleys" being smooth rolls meshed together and driven by friction, wherein the reduction ratio is governed by the respective diameters of the smooth rolls.

Therefore, as referred to herein and in the claims, all such rotatable transmission elements are referred to as "timing elements" which should be taken generically to mean either a conventional pulley having a continuous outward-facing groove surrounding a hub, which groove may or may not be toothed; a conventional pinion gear; or a non-toothed roller.

Example of Preferred Embodiment

As mechanism 120 rotates on shaft 112, typically being driven by a moving substrate such as a web or contact cleaning roller, mechanism 120 causes rotation of oscillation sleeve 102, gudgeons 104,106, and oscillation tie bars 113. The oscillation tie bars cause hub 128 to rotate and allow oscillation assembly 118 to also oscillate axially of shaft 112 because oscillation pin 126 travels in spiral groove 124 of oscillation cam 122.

Hub 128 drives second timing pulley 132, which drives fourth timing pulley 138 and attached third timing pulley 136 via second timing belt 146, which drives first timing pulley 123 via first timing belt 144, first timing pulley 123 being connected to oscillation cam 122.

Preferably, first timing pulley 123 which turns with oscillation cam 122 contains 49 teeth; second timing pulley 132 which turns with hub 128 contains 46 teeth; third timing pulley 136 and fourth timing pulley 138 which turn together contain respectively 17 teeth and 16 teeth; first timing belt 144 contains 57 teeth; and second timing belt 146 contains 55 teeth. The net result is that oscillation assembly 118 oscillates axially of shaft 112 at the rate of 1 full oscillation cycle per 391 revolutions of roll 120.

Referring now to FIGS. 9 through 17, a second embodiment 200 of an apparatus for axially oscillating a roller in accordance with the present invention is shown. A working roller 219 is captured between two spring-biased gudgeons 204,206. In this embodiment, working roller 219 is the only element between the gudgeons; oscillating assembly 218 and oscillation mechanism 220 are disposed entirely within and adjacent to first gudgeon 204 which is slidably mounted on a non-rotatable shaft 212. First gudgeon 204 includes a well 207 for receiving oscillating assembly 218. Second gudgeon 206 is also slidably mounted on a second stub shaft 212*a*.

Figures 11, 12, 13:
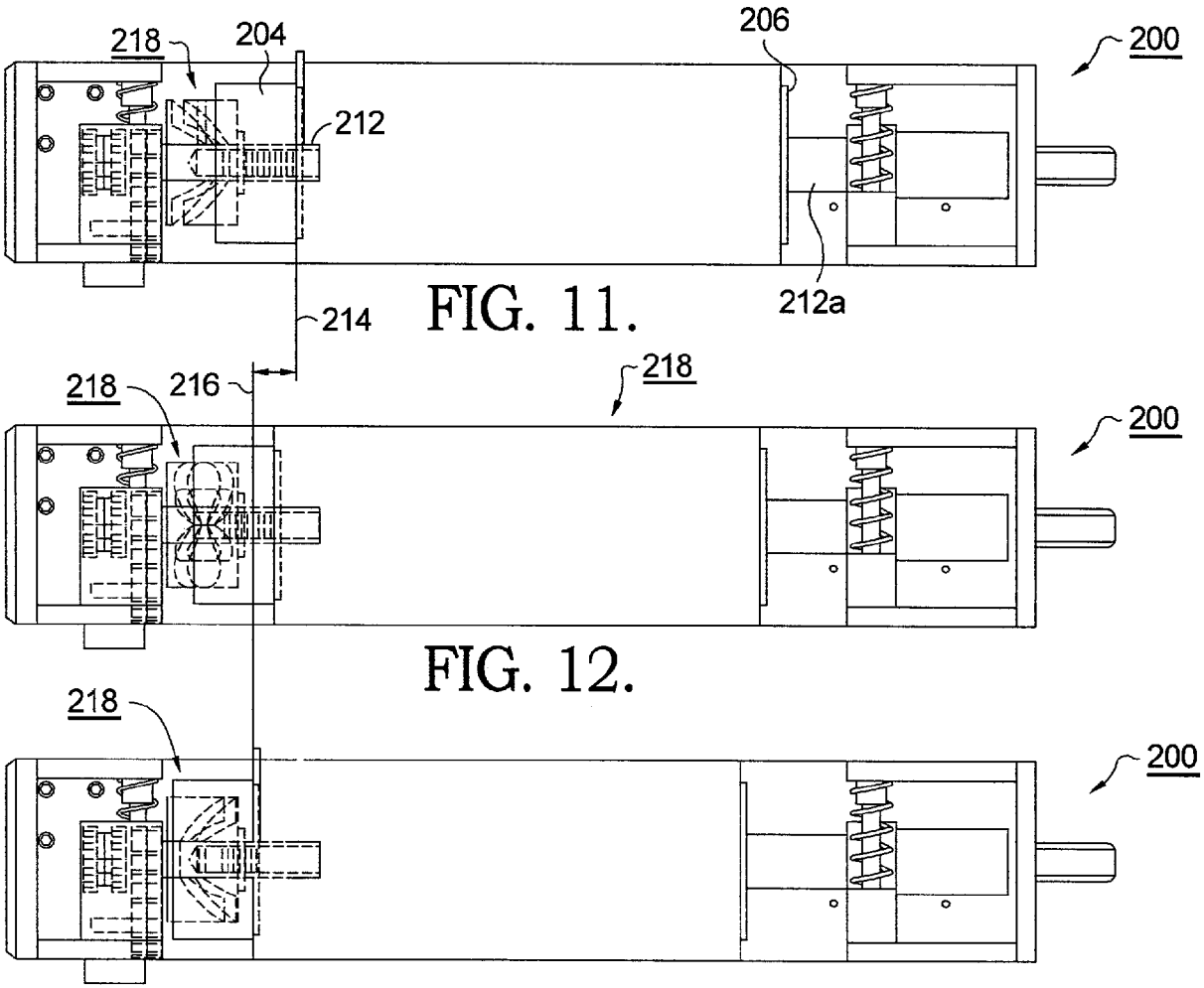
FIGS. 11 through 13 are sequential elevational cross-sectional views showing the embodiment shown in FIG. 9 in, respectively, oscillation right, oscillation center, and oscillation left positions.
Figure 14:
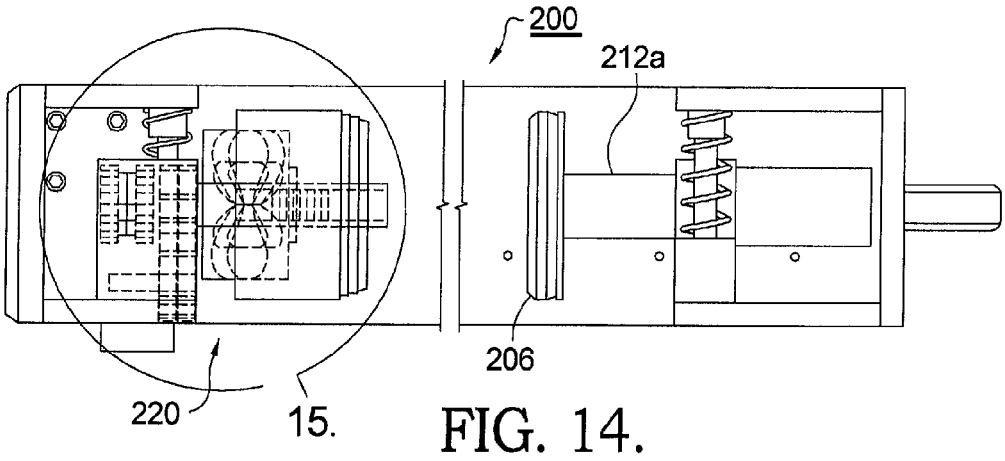
FIG. 14 is a cross-sectional elevational view similar to that shown in FIG. 12.
Figure 15:
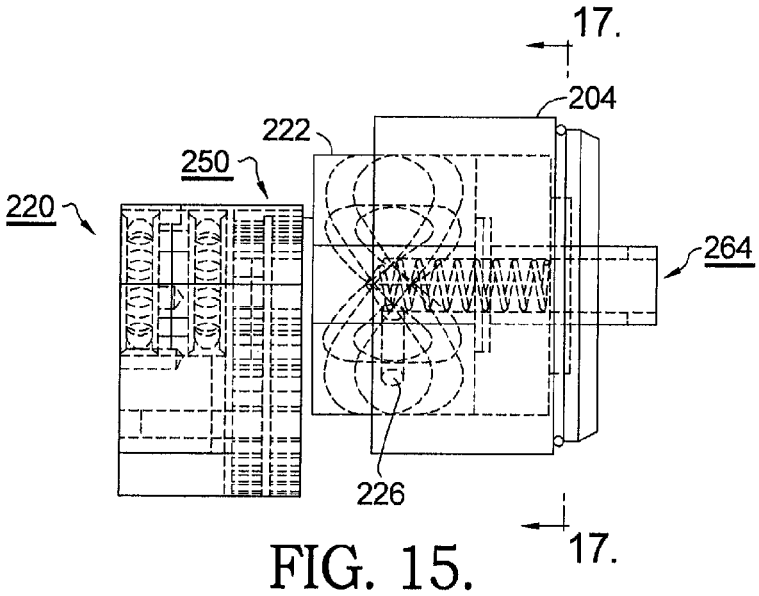
FIG. 15 is an enlarged view of the oscillation mechanism shown in circle 15 in FIG. 14.
Figure 16:
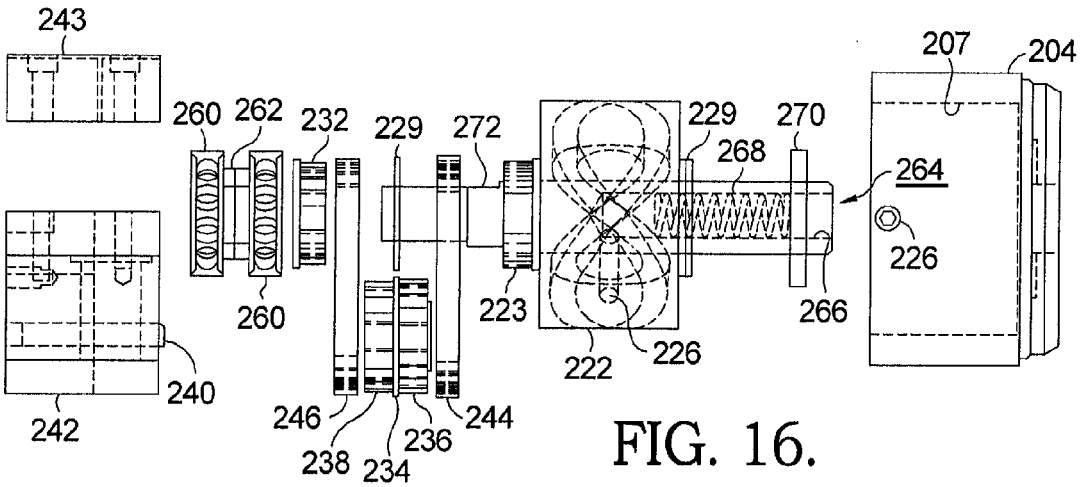
FIG. 16 is an exploded view of the oscillation mechanism shown in FIG. 15.
Figure 17:
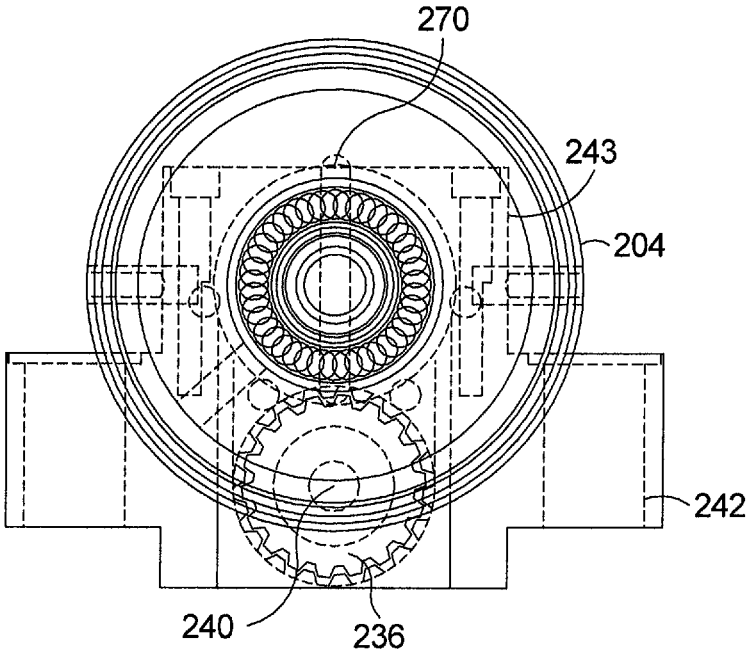
FIG. 17 is an elevational cross-sectional view taken along line 17-17 in FIG. 15.

In operation, working roller 219 and gudgeons 204,206 are caused to oscillate on shafts 212,212*a* between right and left extremes of oscillation 214,216 as shown in FIGS. 11 through 13 and described in detail below. This assembly, referred to herein as an oscillating assembly 218 of embodiment 200, is rotatably driven by frictional contact of working roller 219 with a moving substrate (not shown).

Referring now to FIGS. 14 through 17, oscillation mechanism 220 is fixed in axial position to shaft 212 but is freely rotatable thereupon as described below.

Oscillation mechanism 220 comprises an oscillation cam 222 having at least one spiral groove 224 formed in the surface thereof for receiving at least one oscillation pin 226 installed through the wall of gudgeon well 207 and extending radially inward therefrom. Preferably, a plurality of pins 226 are employed to prevent cocking of the mechanism on the shaft. Oscillation cam 222 includes a first timing pulley 223. Oscillation cam 222 is bounded by respective bronze thrust washers 229. A second timing pulley 232 is disposed on shaft 212. Pulley hub 234 has integral third and fourth timing pulleys 236,238 disposed on opposite ends of hub 234. Pulley hub 234 is rotatably supported on bronze shaft 240 extending from bearing housing 242. A bearing cap 243 closes bearing housing 242. A first timing belt 244 is connected to first timing pulley 223 and third timing pulley 236. A second timing belt 246 is connected to second timing pulley 232 and fourth timing pulley 238.

Shaft 212 is journalled for rotation in double roller bearings 260 separated by bearing spacers 262 and disposed in bearing housing 242.

Shaft 212 is slotted at the inner end 264 and is further provided with a counterbore 266 for receiving a compression spring 268 to counteract the force of the biasing spring in gudgeon 206. A drive pin 270 is disposed transversely of shaft 212 in compressive engagement with spring 268. During assembly, gudgeon 206 is installed over shaft end 264 and in interior engagement within well 207 with drive pin 270. Thus when gudgeon 206 is rotated in operation, shaft 212 is caused to rotate by drive pin 270. The installation of oscillation pin(s) 226 retains the gudgeon in place.

A flat 272 on shaft 212 engages second timing pulley 232 to cause the pulley to rotate with shaft 212.

The numbers of teeth in the four timing pulleys and in the two timing belts are carefully selected to provide for a desired ratio of rotation rate between oscillating assembly 218 and oscillation mechanism 220. Thus the timing pulleys and timing belts define a reduction transmission 250 having a fixed reduction ratio.

Note that the embodiment just described comprises toothed pulleys and toothed belts, in which case the reduction ratio is governed by the number of teeth on respective of the toothed pulleys. Alternatively, the pulleys may be non-toothed, in which case the reduction ratio is governed by the diameters of respective of the non-toothed pulleys.

Note further that pinion gears may be substituted for toothed pulleys; in a special case, belts 244,246 may be omitted and the pinion gears meshed directly.

In either case, as referred to herein and in the claims, the term "pulley" should be taken generically to mean either a conventional pulley having a continuous outward-facing groove surrounding a hub, or a conventional pinion gear.

Example of Preferred Embodiment

As roll 219 rotates, typically being driven by a moving substrate such as a web or contact cleaning roller, roll 219 rotates gudgeons 204,206, causing shaft 212 to rotate and allowing oscillation assembly 218 to also oscillate axially of shafts 212,212*a* because oscillation pin(s) 226 travels in spiral groove 224 of oscillation cam 222.

Shaft 212 drives second timing pulley 232, which drives fourth timing pulley 238 and attached third timing pulley 236 via second timing belt 246, which drives first timing pulley 223 via first timing belt 244, first timing pulley 223 being connected to oscillation cam 222.

Preferably, first timing pulley 223 which turns with oscillation cam 222 contains 49 teeth; second timing pulley 232 which turns with shaft 212 contains 46 teeth; third timing pulley 236 and fourth timing pulley 238 which turn together contain respectively 17 teeth and 16 teeth; first timing belt 244 contains 57 teeth; and second timing belt 246 contains 55 teeth. The net result is that oscillation assembly 218 oscillates axially of shafts 212,212*a* at the rate of 1 full oscillation cycle per 391 revolutions of roll 219.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A system for oscillating a working roller disposed between first and second gudgeons slidably and rotatably disposed on a non-rotatable shaft, comprising:

an oscillating assembly disposed for oscillation and rotation on said shaft; and an oscillation mechanism disposed for rotation on said shaft and connected to said oscillating assembly, wherein said oscillation mechanism comprises:

at least one tie rod connecting said first and second gudgeons;

at least one oscillation pin connected to said tie rod and extending radially inwards from said tie rod toward said shaft, an oscillation cam rotatable on said shaft and including a first timing element;

wherein the oscillating assembly is oscillated by the oscillation pin in cooperation with the oscillation cam; and wherein said oscillation mechanism includes a reduction transmission having a plurality of timing elements rotationally connected in an arrangement to yield a desired rotation ratio between said oscillating assembly and said oscillation mechanism.

2. A system in accordance with claim 1 wherein at least one of said timing elements is selected from the group consisting of a conventional pulley having a continuous outward-facing groove surrounding a hub, which groove may be toothed; a conventional pinion gear; and a non-toothed roller.

3. A system in accordance with claim 1 further comprising at least one belt in said reduction transmission.

4. A system in accordance with claim 3 wherein said at least one belt is a toothed belt and wherein at least one of said timing elements is a toothed pulley engaged with said toothed belt.

5. A system in accordance with claim 3 wherein at least one of said belts is a non-toothed belt and wherein at least one of said timing elements is a non-toothed pulley engaged with said non-toothed belt.

6. A system in accordance with claim 1 wherein said timing elements are connected by a plurality of belts, and wherein said rotation ratio is governed by the respective diameters of respective of said timing elements.

7. A system in accordance with claim 1 wherein said oscillation mechanism is contained wholly within said oscillating assembly.

8. A system in accordance with claim 1 further comprising a plurality of bearings disposed between said gudgeons and said shaft.

9. A system in accordance with claim 1 further comprising an oscillation tubing sleeve surrounding said tie rod and extending between said first and second gudgeons.

10. A system in accordance with claim 7 wherein said oscillation mechanism comprises:

an oscillation hub disposed on said shaft and rotatably supportive of said oscillation cam and engagable with said oscillating assembly and having a second timing element;

a pulley hub supportive of third and fourth timing elements;

a first timing belt connected to said first and third timing elements; and a second timing belt connected to said second and fourth timing elements.

11. A system in accordance with claim 10 wherein said first, second, third, and fourth timing elements and said first and second timing belts define said reduction transmission.

12. A system in accordance with claim 11 wherein the reduction ratio of said reduction transmission is about 391:1.

13. A system in accordance with claim 10 wherein at least one of said timing elements is a toothed pulley.

14. A system in accordance with claim 10 wherein at least one of said timing elements is a non-toothed pulley.

15. A system in accordance with claim 10 wherein at least one of said timing elements is a pinion gear.

16. A system in accordance with claim 10 wherein at least one of said timing elements is a smooth roller.

17. A system in accordance with claim 10 wherein all of said timing elements are toothed and wherein said reduction ratio is governed by the number of teeth on respective of said toothed timing elements.

18. A system in accordance with claim 10 wherein all of said timing elements are non-toothed and wherein said reduction ratio is governed by the diameters of respective of said non-toothed timing elements.

* * * * *